United States Patent [19]

Pringle

[11] Patent Number: 4,676,307

[45] Date of Patent: Jun. 30, 1987

[54] PRESSURE CHARGED LOW SPREAD SAFETY VALVE

[75] Inventor: Ronald E. Pringle, Houston, Tex.

[73] Assignee: Camco, Incorporated, Houston, Tex.

[21] Appl. No.: 612,271

[22] Filed: May 21, 1984

[51] Int. Cl.[4] ..... E21B 34/10

[52] U.S. Cl. ..... 166/322; 166/72; 166/324

[58] Field of Search ..... 166/72, 321, 322, 323, 166/324, 332

[56] References Cited

U.S. PATENT DOCUMENTS

| | | | |
|---|---|---|---|
| 3,750,751 | 8/1973 | Mott | 166/72 |
| 3,782,461 | 1/1974 | Watkins | 166/72 |
| 4,077,473 | 3/1978 | Watkins | 166/323 |
| 4,252,197 | 2/1981 | Pringle | 166/322 |
| 4,373,587 | 2/1983 | Pringle | 166/324 |
| 4,448,254 | 5/1984 | Barrington | 166/324 |
| 4,515,219 | 5/1985 | Beck | 166/324 |

*Primary Examiner*—Stephen J. Novosad
*Assistant Examiner*—William P. Neuder

[57] ABSTRACT

A well safety valve having a housing and a valve closure member moving between opened and closed positions by a longitudinally tubular member movable in the housing. A piston and cylinder assembly includes a seal between the piston and cylinder, is connected to the tubular member, and is actuated by hydraulic fluid from the well surface for moving the valve to an open position. The valve is biased to a closed position by a U-shaped chamber. The chamber includes a pressurized gas and hydraulic fluid in the chamber between the gas and the assembly seal for lubricating and preventing the gas from escaping through the seal. The piston cylinder assembly is out of communication with and unaffected by pressure in the bore. At least one actuator rod is connected between the assembly and the tubular member and includes first and second spaced seals. The pressure in the bore is in communication with the rod between the first and second seals thereby balancing the housing pressure on the rod. The second sides of the first and second seals are in communication with the hydraulic fluid thereby balancing the hydraulic control pressure on the actuator rod.

4 Claims, 13 Drawing Figures

26
42
40
11
10
12
40
30
13
33
11
29
28
50
7
6
5
34
32
36
38
46
4
56
20
52
12
46
7
6
5
4

62
52
3
2
2
3
54
20
70
11
12
58
60
13
24
88
84
11
12
86
20
12
14
18
22
16

PRESSURE CHARGED LOW SPREAD SAFETY VALVE

BACKGROUND OF THE INVENTION

Generally, it is known to provide a subsurface well safety valve for use in a well for shutting off flow of well fluid through the well tubing in which the safety valve is actuated to an open position by hydraulic control fluid from the well surface, is biased to the closed position by a pressurized gas chamber which acts oppositely to the hydraulic control fluid on the operating piston, and uses small rod pistons to provide a low spread between the opening and closing pressures, as shown in U.S. Pat. No. 4,252,197. However, if the piston seal fails, the gas may escape and the valve closing force may become impaired causing a valve failure. Furthermore, in some valves, the tubing pressure or pressure in the housing bore works against the hydraulic control fluid from the surface. This requires increased hydraulic control pressure acting against the tubing or housing pressure which is undesirable, as well as variable, in some applications.

The present invention is directed to various improvements in a low spread piston and cylinder actuated subsurface safety valve having a pressure charged chamber which is constructed to reduce the possible loss of the gas charge in the chamber. A U-shaped gas chamber is exposed to a single seal on the piston which is lubricated on both sides with hydraulic fluid. In addition, the valve is constructed so that the well pressure in the well tubing or housing bore does not affect the opening or closing of the safety valve and thus provides a so-called balanced valve insofar as the effect of well tubing pressure is concerned.

SUMMARY

The present invention is directed to a low spread well safety valve for controlling the fluid flow through a well conduit and including a tubular housing having a bore and a valve closure member moving between open and closed positions. A longitudinal tubular member is telescopically movable in the housing for controlling the movement of the valve closure member. The improvement of the present invention is directed to means for moving the tubular member in a first direction for causing the valve closure member to move to the closed position and means for moving the tubular member in a second direction for opening the valve closing member. Thus, a piston and cylinder assembly having a seal therebetween is positioned in the housing, one of which is connected to the tubular member. One side of the assembly is in communication with a hydraulic passageway adapted to extend to the well surface for actuating the tubular member in a second direction by hydraulic control fluid to open the valve closure member. A pressurized gas U-shaped chamber is positioned in the housing in communication with the second side of the assembly. The chamber includes a pressurized gas in the chamber acting to move the tubular member in the first direction to open the valve. The chamber, in addition to the pressurized gas includes a hydraulic fluid positioned between the gas and the piston and cylinder seal thereby preventing gas from contacting and escaping through the seal by lubricating both sides of the seal with hydraulic fluid.

Still a further object of the present invention is wherein at least one actuator rod is connected between the assembly and the tubular member in which the rod includes first and second spaced seals. Pressure in the housing bore is in communcation with the rod between the first and second spaced seals thereby balancing the housing bore pressure or tubing pressure on the actuator rod. In addition, the second sides of the first and second spaced seals are in communication with the hydraulic control fluid from the well surface thereby balancing the hydraulic control pressure on the actuator rod.

Yet a still further object of the present invention is wherein the piston and cylinder assembly is out of communication with the pressure in the bore thereby providing a balanced valve insofar as the effect of well tubing pressure is concerned.

Other and further objects, features and advantages will be apparent from the following description of a presently preferred embodiment of the invention, giving for the purpose of disclosure and taken in conjunction with the accompanying drawings.

DESCRIPTION OF THE PREFERRED EMBODIMENT

Figures 1A, 1B:
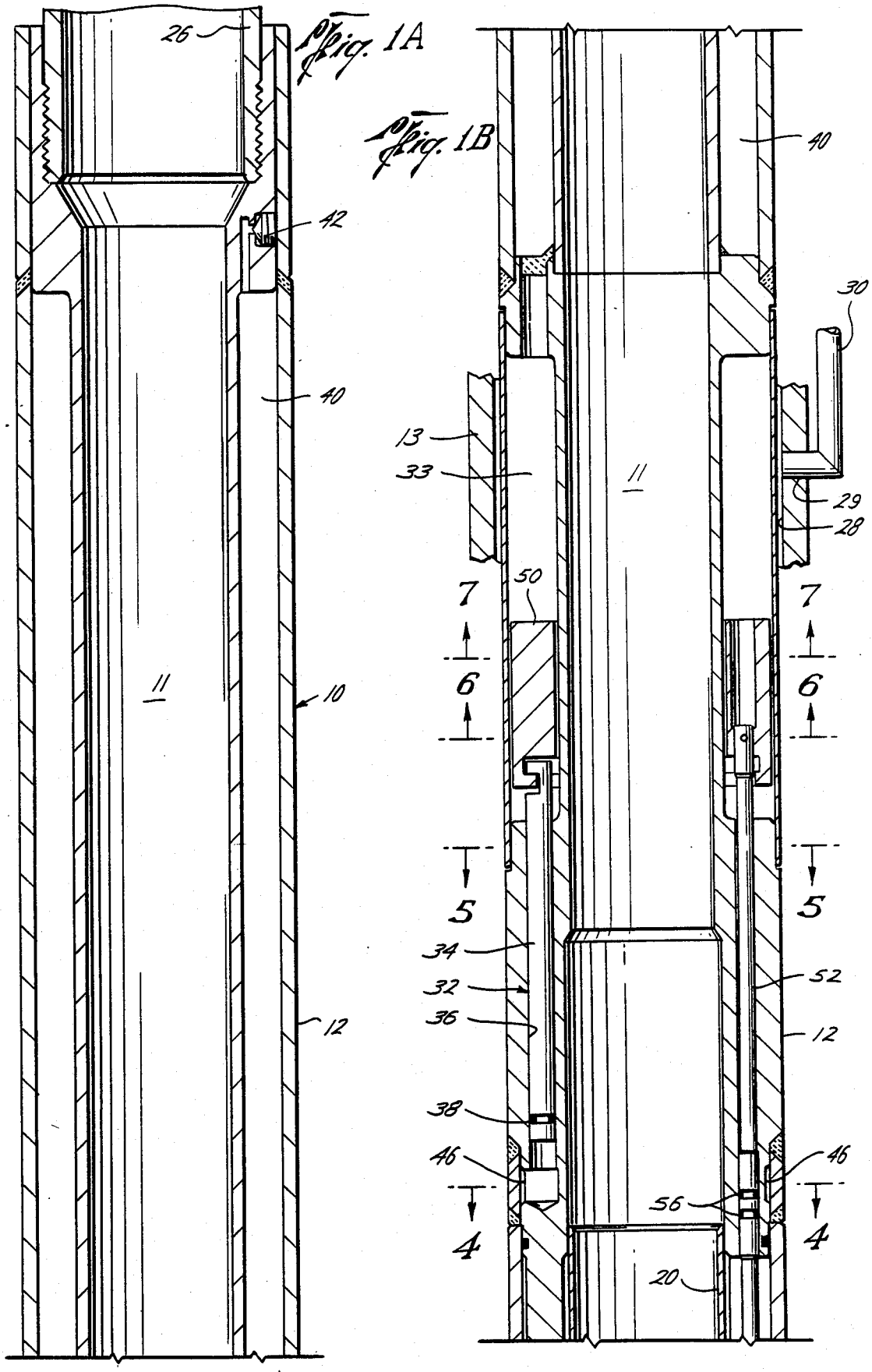
FIGS. 1A, 1B, 1C and 1D are continuations of each other and are elevational views, in cross section, of the well safety valve of the present invention shown in the open position.

While the present improvements in a subsurface safety valve will be shown, for purpose of illustration only, as incorporated in a flapper type tubing retrievable safety valve, it will be understood that the present invention may be used with other types of safety valves and safety valves having various types of valve closure members.

Referring now to the drawings, and particularly to FIGS. 1A, 1B, 1C and 1D, a retrievable type of subsurface safety valve is shown utilizing the present invention and generally indicated by the reference numeral 10. The safety valve 10 generally includes a body 12 adapted to be positioned in a well conduit 13 such as oil and or gas well tubing to permit production therethrough under normal operating conditions but in which the valve 10 may close or be closed in response to abnormal conditions such as might occur when the well overproduces, blows wild, or in the event of a failure of well equipment.

Figures 1C, 1D:
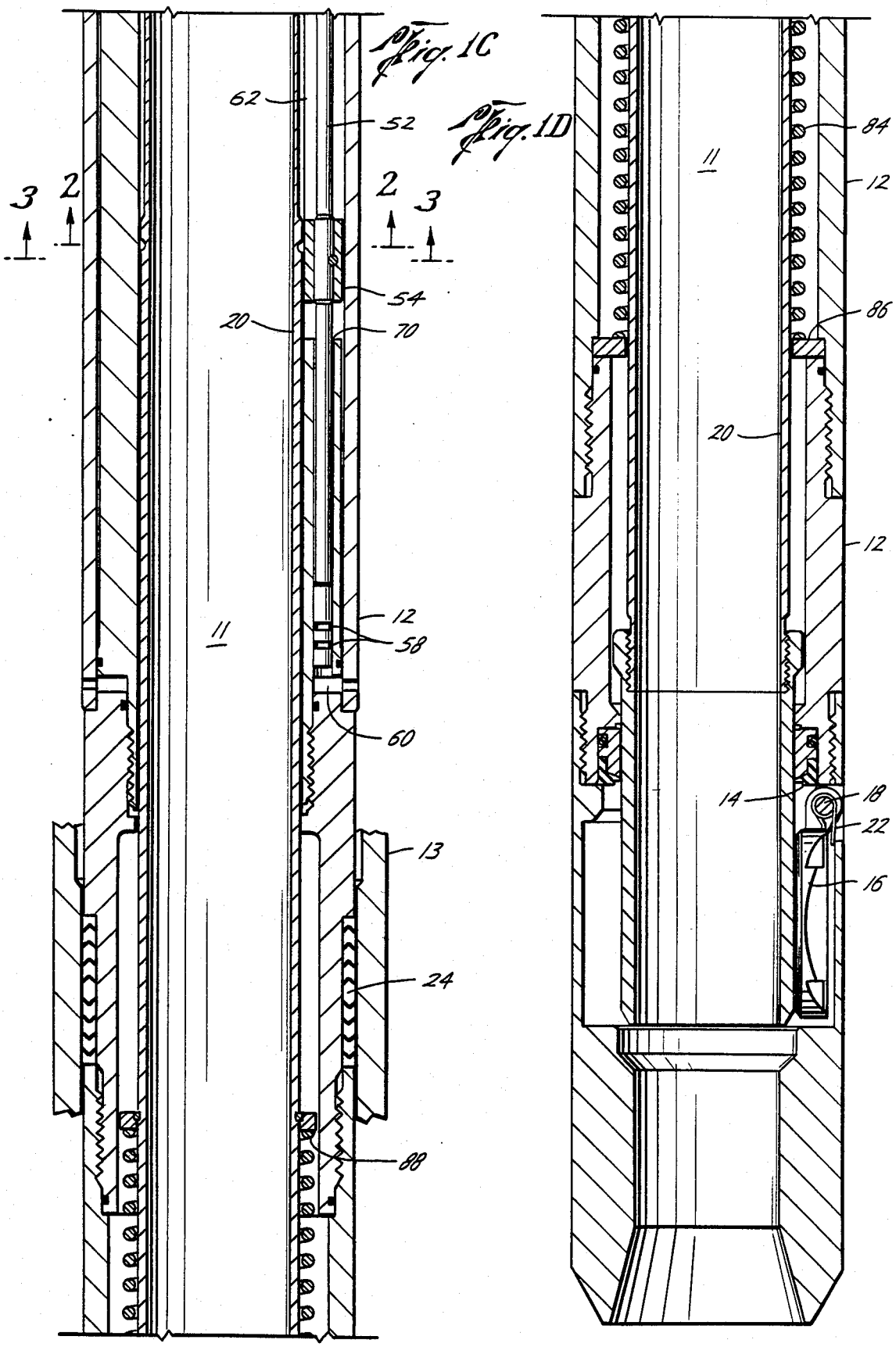
Figure 8A:
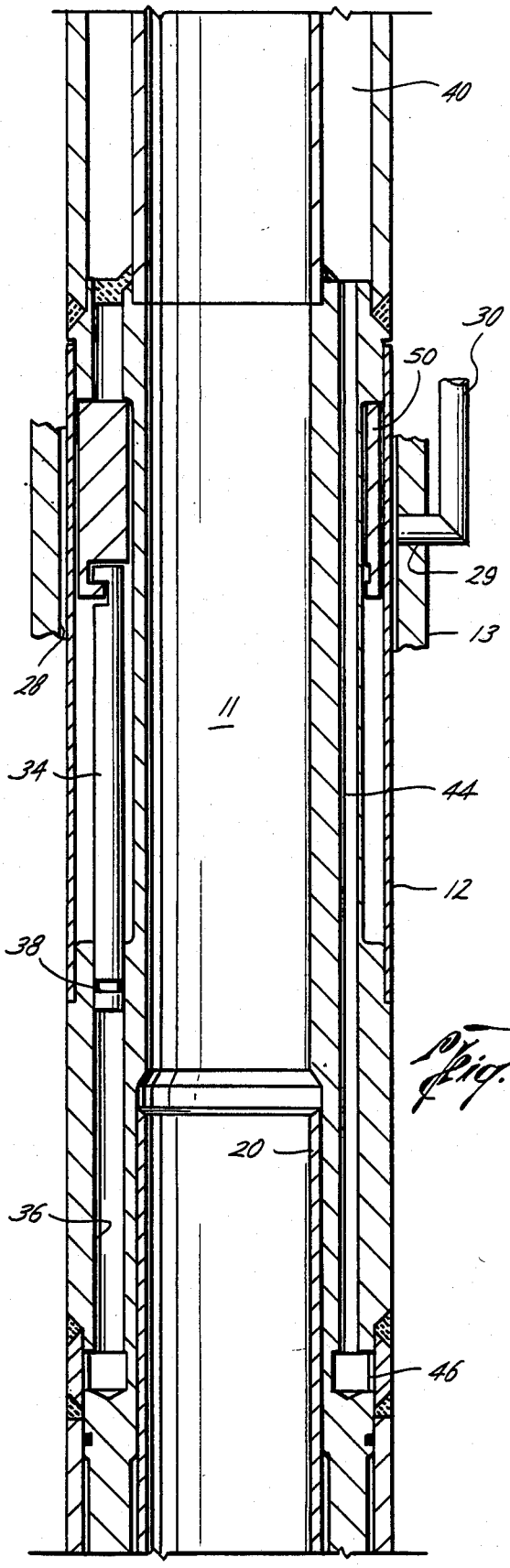
FIG. 8A is a fragmentary cross-sectional view taken along the lines 8A—8A of FIGS. 5, 6 and 7 with the valve parts in the valve closed position.
Figure 8B:
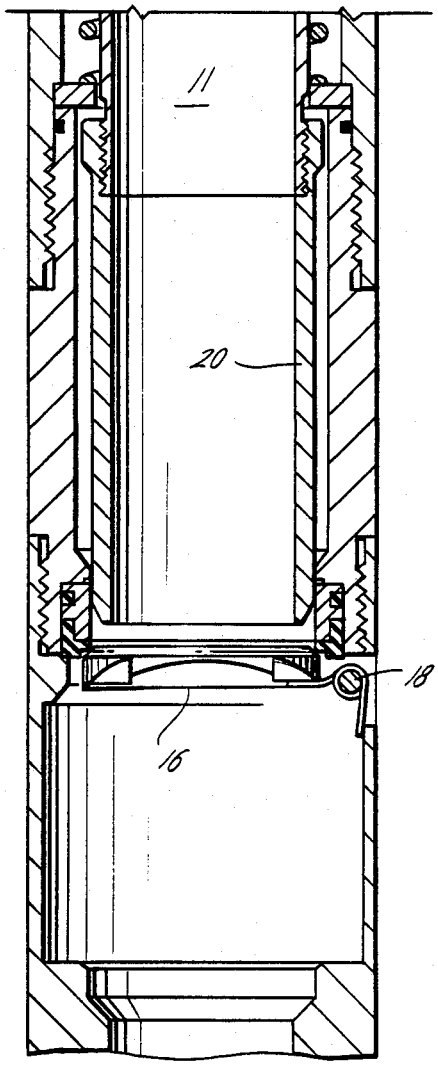
FIG. 8B is a fragmentary elevational cross-sectional view of the lower end of the safety valve shown in the closed position.

As best seen in FIG. 1D, the body 12 generally includes an annular valve seat 14 and a valve closure member such as a flapper 16 connected to the body 12 by a pivot pin 18. Thus when the flapper 16 is in the upper position seated on the valve seat 10 (FIG. 8B), the safety valve 10 is closed blocking flow upwardly therethrough. A tubular member or sliding tube 20 is telescopically movable in the body 12 and through the valve seat 14. As best seen in FIG. 1D, when the sliding tube 20 is moved to a downward position, the tube 20 pushes against the flapper 16 and moves the flapper 16 away from the valve seat 14. Thus the valve 10 is held in the open position so long as the sliding tube 20 is in the downward position. When the sliding tube 20 is moved upwardly, the flapper 16 is allowed to move upwardly closing the valve by the action of a spring 22 and also by the action of the fluid flow moving upwardly through the bore 11 of the body 12.

One feature of the present invention is directed to an improved low spread well safety valve in which a pressurized gas chamber acts to bias the valve 10 towards a closed position and a hydraulic control pressure extending from the well surface acts to move the valve towards an open position.

Figure 5:
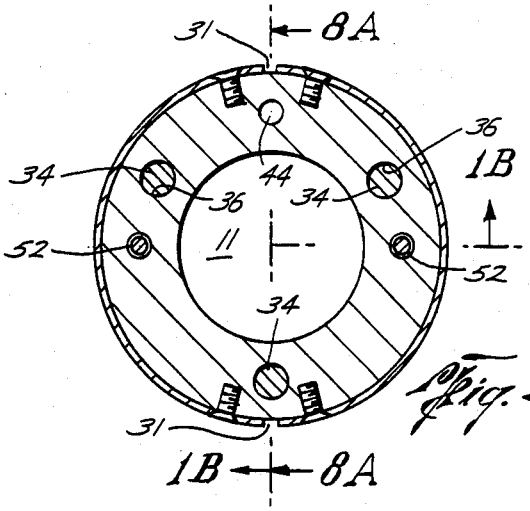
FIG. 5 is a cross-sectional view taken along the line 5—5 of FIG. 1B.
Figure 3:
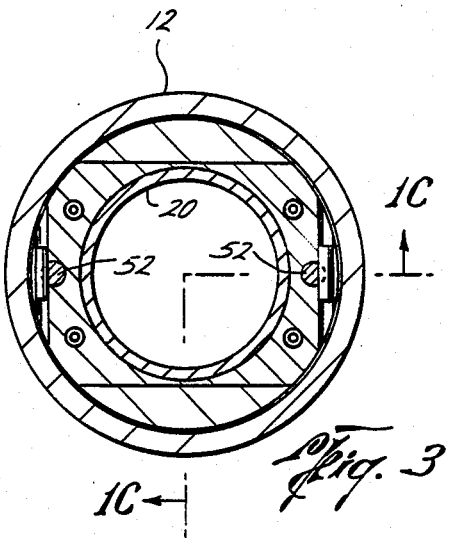
FIG. 3 is a cross-sectional view taken along the line 3-3 of FIG. 1C.
Figure 6:
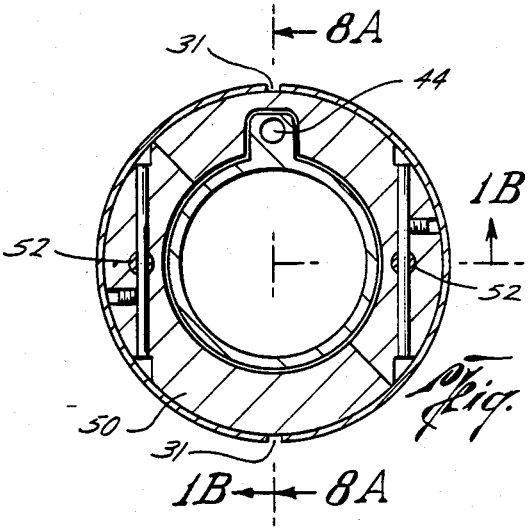
FIG. 6 is a cross-sectional view taken along the line 6—6 of FIG. 1B.
Figure 4:
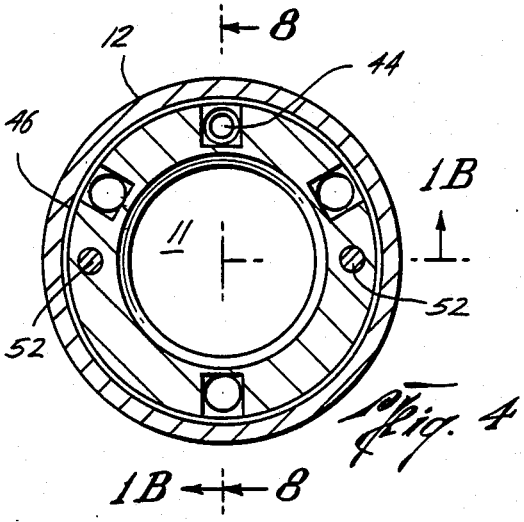
FIG. 4 is a cross-sectional view taken along the line 4—4 of FIG. 1B.
Figure 7:
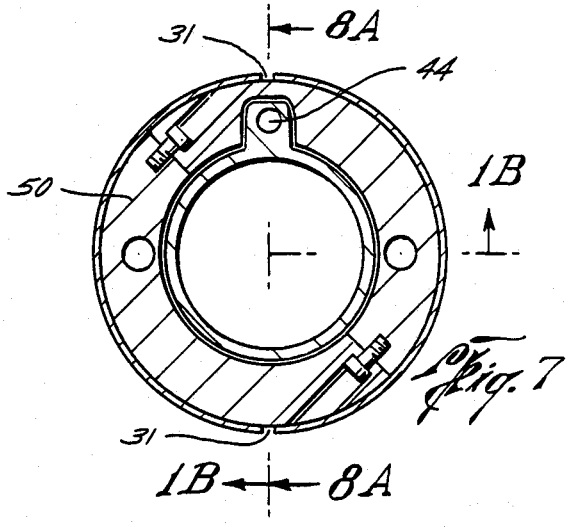
FIG. 7 is a cross-sectional view taken along the line 7—7 of FIG. 1B.

Referring now to FIGS. 1B and 5, a piston and cylinder assembly generally indicated by the reference numeral 32, one of which, such as one or more pistons 34, here shown as three, moves in cylinders 36, and is connected to the tubular member 20 as will be more fully discussed hereinafter. The piston and cylinder assembly 34 includes a seal 38 between each piston 34 and cylinder 36. One side of the assembly 32 is in communication with hydraulic control fluid adapted to extend to the well surface for actuating the piston 34 in a direction to open the flapper valve 16. Thus, the valve housing 12 includes a first seal 24 (FIG. 1C) for seating against the interior of the well conduit 13, and includes a well lock 26 (FIG. 1A) which locks and supports the safety valve 10 in the well conduit 13 and includes a seal (not shown) for sealing off against the well conduit 13. The lock may be any suitable lock such as a Camco Type M lock. Thus, the seal in the well lock 26 and the seal 24 form an annular hydraulic chamber 28 between the interior of the well conduit 13 and the exterior of the body 12 of the safety valve 10. A port 29 is provided in the well conduit 13 which may be exposed to the well annulus or to a control line 30 extending to the well surface for controlling the operation of the safety valve 10. Openings 31 are provided in the body 12 for receiving the hydraulic control fluid which flows into a hydraulic passageway 33 for acting on the upper end of the hydraulic pistons 34.

Referring now to FIGS. 1A, 1B, 4, 5, 6 7 and 8A, a closed, preferably welded, U-shaped chamber 40 is provided having a port 42 for charging the chamber. The chamber 40 includes a tubular passageway 44 extending downwardly (FIGS. 5, 6, 7 and 8A), and includes an annular passageway 46 which connects to the cylinders 36 below the pistons 34 and seals 38. Thus, pressurized gas in the chamber 40 acts on the piston and cylinder assembly 32 for biasing the valve 10 to the closed position but is not exposed to other seals which may fail causing loss of the closing pressure. While the U-shaped pressurized chamber 40 (which includes the cylinders 36) contains pressurized gas to resiliently bias the pistons 34 to the upward position, the chamber 40 also includes a hydraulic fluid therein between the gas and the seals 38. That is, a sufficient amount of hydraulic fluid is placed in the chamber 40 which will flow by gravity to the bottom of the chamber 40, into the tubular passageway 44, into the annular passageway 46, and the cylinders 36 to prevent the contact of the seals 38 by gas in the chamber 40. This has the important advantage over the prior art in that the pressurized gas in the chamber 40 is kept out of contact with the seals 38. The advantage of this structure is that the seals 38 are lubricated on both sides by hydraulic fluid and thus are less likely to leak.

It is to be noted that the small cross-sectional area pistons 34 do not substantially affect the pressure in the gas chamber 40 as the pistons 34 move from the closed to the open position whereby the spread or differential between the opening and closing pressures are minimized allowing the valve to be used at greater depths in the well.

Another feature of the present invention is to insure that the safety valve 10 is unaffected by the pressure in the well tubing and in the bore 11. That is, in many hydraulic actuated safety valves, the well pressure in the bore 11 acts on the valve in a direction to work against the hydraulic control fluid which may be undesirable in some applications. In the present invention, the hydraulic piston and cylinder assembly 32 is out of communication with the pressure in the bore 11 and thus is not affected by the tubing pressure. However, this precludes the piston and cylinder assembly 32 from directly actuating the tubular member 20 which opens and closes the flapper 16.

Referring now to FIGS. 1B, 1C, 4 and 5, the pistons 32 are connected to an annular ring 50 which in turn are connected to one or more actuator rods 52, here shown as two, which include a connection 54 which is in turn connected to the tubular member 20. While U.S. Pat. No. 4,373,587 discloses actuator rods, the valve structurally and operationally are different.

The actuator rods 52 include first 56 and second 58 spaced seals. One side of the first seal 56 is exposed to hydraulic pressure in the hydraulic passageway 33 and one side of the second seals 58 is exposed to a vent 60 which is in communication with the hydraulic control fluid in the annulus 28 above the seal 24. Thus, the actuator rods 52, being of the same cross-sectional area, are balanced and unaffected by the hydraulic control fluid from the well surface. The tubular member 20 which is telescopically movable in the housing 12 is not sealed relative to the interior of the housing 12. Therefore, tubing pressure or pressure in the bore 11 will enter into the space 62 and act against both of the second sides of the first seal 56 and the second seal 58 whereby the effect of the tubing pressure on the actuator rods 52 is balanced. Therefore, the safety valve 10 provides a so-called tubing pressure balanced valve.

Figure 2:
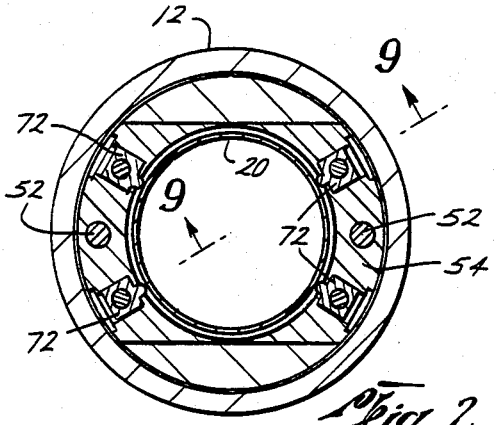
FIG. 2 is a cross-sectional view taken along the line 2—2 of FIG. 1C.
Figure 9:
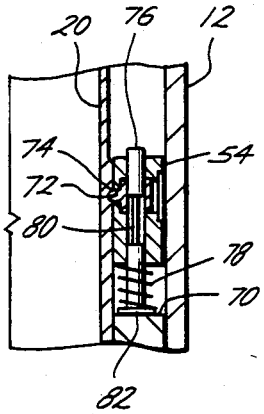
FIG. 9 is a cross-sectional view taken on the line 9—9 of FIG. 2.

Referring now to FIGS. 1C, 1D, 2, 3 and 9, the connection 54 between the actuator rods 52 and the tubular member 20 may be releasable. That is, it is desirable, under some conditions, that in the event that the hydraulic control pressure becomes greater than a predetermined maximum, for example, in the case that casing annulus is used for the control fluid and tubing pressure is leaking into the annulus 28 tending to open the valve, that the valve 10 still be closable. Thus, upon an increase of pressure in the annulus 28 above a predetermined maximum, the connection 54 will engage a shoulder 70 in the housing 12 (FIGS. 1C and 9). As best seen in FIGS. 2 and 9, the connection 54 includes a plurality of detents 72 engaging a groove 74 in the outer periphery of the tubular member 20. A pin 76 in longitudinally movable in the member 54 and downwardly biased by a spring 78 to place the pin behind the detents 72 locking them in the groove 74. The rod 76 includes a recess 80. Thus, upon overpressuring the valve 10, the connection 54 moves downwardly and the bottom 82 of the pin 76 contacts the shoulder 70 moving the recess 80 behind the detents 72. As the detents are retracted, a spring 84 (FIGS. 1C and 1D) which is biased between a shoulder 86 on the housing 12 and a shoulder 88 on the flow tube 20 moves the now released flow tube 20 upwardly allowing the flapper 16 to close.

In use, the valve 10 is installed in a well conduit such as a production tubing 13 and locked therein with upper and lower seals between the body 12 and the interior of the production tubing 13 on either side of the port 29. Normally, the tubular member 20 is biased upwardly by the action of the pressurized gas in the chamber 40 which acts on the underside of the pistons 30 which in turn push the ring 50 upwardly carrying the actuator rods 52 and the tubular member 20 upwardly to allow the flapper valve 16 to close. The safety valve 10 is controlled from the well surface by the application of the removal of pressure through the port 29 such as through a control line 30 or casing annulus to act on the top of the seals 38 of the pistons 34 and overcome the biasing gas pressure in the chamber 40. If the applied pressure is of a sufficient magnitude, the pistons 34 will move downwardly carrying the annular ring 50 downwardly, which in turn carries the actuator rods 52 downwardly and moves the tubular member 20 downwardly through and opening the flapper 16. If the hydraulic control pressure through the port 29 is reduced sufficiently, the pressurized gas charge in the chamber 40 will again move the pistons 34 upwardly and allow the valve 10 to close. And in the event that the pressure in the hydraulic pressure chamber 34 becomes greater than a predetermined maximum, the connection 54 between the actuator rods 52 and the tubular member 24 will move downwardly, engage the shoulder 70 and release from the tubular member 20 which will be driven upwardly by the spring 84 allowing the valve to close.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. In a well safety valve for controlling the fluid flow through a well conduit and including a tubular housing having a bore and a value closure member moving between open and closed positions, a longitudinal tubular member telescopically movable in the housing for controlling the movement of the vale closure member, the improvement in means for moving the tubular member in a first direction for causing the valve closure member to move to the closed position and means for moving the tubular member in a second direction for opening the valve closure member comprising, a piston and cylinder assembly having a seal therebetween positioned in the housing, and one of which is connected to the tubular member, one side of said assembly and seal being in communication with a hydraulic passageway adapted to extend to the well surface for actuating the tubular member in the second direction to open said valve closure member, a pressurized closed U-shaped chamber in the housing in communication with the second side of said assembly and said seal acting to move the tubular member in the first direction, said chamber extending from a position below the seal of the piston and cylinder assembly to a position above the seal, said chamber including a pressurized gas in the chamber and a hydraulic fluid in the chamber between the gas and the seal thereby lubricating and preventing the gas from contacting the seal.

2. The apparatus of claim 1 including, at least one actuator rod connected between the assembly and the tubular member, said rod including first and second spaced seals, pressure in the housing bore being in communication with the rod between the first and second spaced seals thereby balancing the housing pressure on the actuator rod, the second sides of the first and second spaced seals in communication with the hydraulic passageway thereby balancing the hydraulic control pressure on the actuator rod.

3. The apparatus of claim 2 wherein the piston and cylinder assembly is out of communication with the pressure in the bore.

4. In a well safety valve for controlling the fluid flow through a well conduit and including a tubular housing having a bore and a valve closure member moving between open and closed positions, a longitudinal tubular member telescopically movable in the housing for controlling the movement of the valve closure member, the improvement in means for moving the tubular member in a first direction for causing the valve closure member to move to the closed position and means for moving the tubular member in a second direction for opening the valve closure member comprising, a piston and cylinder assembly having seal therebetween and positioned in the housing, one side of said assembly being in communication with a hydraulic passageway adapted to extend to the well surface for actuating the tubular member in the second direction to open said valve closure member, a pressurized gas chamber in the housing in communication with the second side of said assembly acting to move the tubular member in the first direction, at least one actuator rod connected between the assembly and the tubular member, said rod including first and second spaced seals, pressure in the bore being in communication with the rod between the first and second seals thereby balancing the housing pressure on the actuator rod, the second sides of the first and second seals being in communication with the hydraulic passageway thereby balancing the hydraulic control pressure on the actuator rod, and said piston and cylinder assembly being out of communication with the pressure in the bore.

* * * * *

UNITED STATES PATENT OFFICE

CERTIFICATE OF CORRECTION

Patent No. 4,676,307 Dated June 30, 1987

Inventor(s) Ronald E. Pringle

It is certified that error appears in the above-identified patent and that said Letters Patent are hereby corrected as shown below:

Column 5, line 59, delete "value" and insert -- valve --

Column 5, line 62, delete "vale" and insert -- valve --

Signed and Sealed this

Twenty-ninth Day of December, 1987

*Attest:*

DONALD J. QUIGG

*Attesting Officer*

*Commissioner of Patents and Trademarks*